US010835004B2

(12) United States Patent
Scrone-Smith

(10) Patent No.: US 10,835,004 B2
(45) Date of Patent: Nov. 17, 2020

(54) APPARATUS AND DEVICES FOR RESPONSIVE UMBRELLA WITH HANDS-FREE MECHANISM

(71) Applicant: Deborah Scrone-Smith, Ponte Vedra, FL (US)

(72) Inventor: Deborah Scrone-Smith, Ponte Vedra, FL (US)

( * ) Notice: Subject to any disclaimer, the term of this patent is extended or adjusted under 35 U.S.C. 154(b) by 0 days.

(21) Appl. No.: 16/450,960

(22) Filed: Jun. 24, 2019

(65) Prior Publication Data

US 2019/0307254 A1 Oct. 10, 2019

Related U.S. Application Data

(63) Continuation of application No. 15/863,921, filed on Jan. 6, 2018, now Pat. No. 10,376,069.

(60) Provisional application No. 62/443,592, filed on Jan. 6, 2017.

(51) Int. Cl.

| | |
|---|---|
| ***A45B 11/02*** | (2006.01) |
| ***A47C 7/66*** | (2006.01) |
| ***A45B 17/00*** | (2006.01) |
| ***A45B 11/00*** | (2006.01) |
| ***A47C 1/12*** | (2006.01) |
| ***A45B 3/00*** | (2006.01) |
| *A45B 23/00* | (2006.01) |

(52) U.S. Cl.

CPC ..... *A45B 11/02* (2013.01); *A45B 3/00* (2013.01); *A45B 11/00* (2013.01); *A45B 17/00* (2013.01); *A47C 1/12* (2013.01); *A47C 7/66* (2013.01); *A45B 2023/0093* (2013.01); *A45B 2200/1009* (2013.01); *A45B 2200/1081* (2013.01)

(58) Field of Classification Search

CPC ..... A45B 11/02

See application file for complete search history.

(56) References Cited

U.S. PATENT DOCUMENTS

| | | | | | |
|---|---|---|---|---|---|
| 191,782 | A * | 6/1877 | Smith, Sr. | A45B 11/02 | 224/190 |
| 225,409 | A * | 3/1880 | Mora | A45B 11/02 | 224/190 |
| 578,572 | A * | 3/1897 | Lashells | A45B 11/02 | 224/189 |
| 881,720 | A * | 3/1908 | Ridout | A45B 11/02 | 224/189 |
| 1,217,542 | A * | 2/1917 | Washington | A45B 11/02 | 224/187 |
| 2,434,526 | A * | 1/1948 | Thornton | A45B 11/02 | 135/16 |
| 6,024,464 | A * | 2/2000 | De Vera | A45B 3/04 | 224/190 |
| 8,851,343 | B1 * | 10/2014 | Evans | A45B 11/02 | 135/20.1 |

(Continued)

*Primary Examiner* — Noah Chandler Hawk

(74) *Attorney, Agent, or Firm* — Wilson Dutra, PLLC; Camille A. Wilson

(57) ABSTRACT

The present disclosure relates to a responsive umbrella with a hands-free mechanism that allows a user to operate and hold the responsive umbrella without requiring the use of their hands. The hands-free mechanism may be a wearable strap or harness. A responsive umbrella may be adjustable for the angle of extension from the hands-free mechanism, which may allow a user to adapt the responsive umbrella for different ambient conditions.

18 Claims, 20 Drawing Sheets

(56) References Cited

U.S. PATENT DOCUMENTS

| | | | | |
|---|---|---|---|---|
| 8,944,300 | B1 * | 2/2015 | Kaufman | A45B 11/02 135/16 |
| 9,375,060 | B1 * | 6/2016 | Bagramyan | A45B 11/02 |
| 2006/0219279 | A1 * | 10/2006 | Kaufman | A45B 11/02 135/20.1 |
| 2010/0313922 | A1 * | 12/2010 | Raider | A45B 11/02 135/16 |

* cited by examiner

200

APPARATUS AND DEVICES FOR RESPONSIVE UMBRELLA WITH HANDS-FREE MECHANISM

CROSS-REFERENCE TO RELATED APPLICATION

This application is a Continuation-in-Part of and claims priority to U.S. Non-Provisional patent application Ser. No. 15/863,921, filed Jan. 6, 2018, and titled "ADJUSTABLE VENUE SEATING APPARATUS AND DEVICES" (which further claimed priority to U.S. Provisional Patent Application Ser. No. 62/443,592, filed Jan. 6, 2017, and titled "RESPONSIVE UMBRELLA APPARATUS AND DEVICES"), the entire contents of which are incorporated herein by reference.

BACKGROUND OF THE DISCLOSURE

From palm leaves to hats on sticks, umbrellas or parasols were traditionally used as a covering from rain or sunlight. The difference between these two typically is the material used for the covering material, since certain parasols are not waterproof. Generally, umbrellas are collapsible with bendable joints allowing for extension or retraction of the covering. This foldable mechanism typically consists of a central pole, which can be made of wood, metal, or plastic. The pole can have wooden or metal ribs to support the foldable covering. An umbrella may be a hand-held device designed for personal, portable use or may be a larger object designed to be stationary in a particular location.

Despite the sophistication and range of umbrella solutions available, umbrellas and parasols continue to have issues that have plagued them since the inception of their creation. These include dealing with harsher environmental elements, such as wind, hail, or sleet; being responsive to a user's need in the moment; and integrating on-demand or predictive functionality. Further, umbrellas continue to be limited on how to address perpendicular or vertical rainfall that is affected by wind and falls on an umbrella holder at an angle. Further, umbrellas historically require use of one or both hands, which may be inconvenient or impractical depending on the circumstances.

SUMMARY OF THE DISCLOSURE

What is needed therefore is a hands-free solution for use of a responsive umbrella. Accordingly, the present disclosure relates to a responsive umbrella with a hands-free mechanism that allows a user to operate and hold the responsive umbrella without requiring the use of their hands. In some aspects, the hands-free mechanism may comprise a wearable strap or harness. In some embodiments, a responsive umbrella may be adjustable for the angle of extension from the hands-free mechanism, which may allow a user to adapt the responsive umbrella for different ambient conditions.

What is also needed is a responsive umbrella that offers a full suite of functionality and variation to meet a user's needs either ahead of time or in the moment. The responsive umbrella combines an umbrella framework, which includes a stem, covering, panels, and ribs, with the needs a user has at any given moment. A rim is also included to increase the stability of the umbrella itself and to give a user more protection against the unpredictability of the elements. A responsive umbrella will resolve common issues users have when handling an umbrella, such as being able to hold it while carrying various other items, or being adaptable to a particular situation or task.

The present disclosure relates to a hands-free responsive umbrella comprising: a responsive umbrella comprising: a cover configured to shield at least a portion of ambient elements for a user of the hands-free responsive umbrella when the responsive umbrella is in an expanded orientation, a cover support structure that provides rigidity to the cover, allowing the cover to maintain a predefined shape in the expanded orientation, at least one stem extending from the cover; and a hands-free mechanism attachable to the at least one stem, wherein the hands-free mechanism allows for use of the responsive umbrella without requiring one or both hands of the user.

In some embodiments, the hands-free mechanism may be wearable. In some aspects, at least a portion of the responsive umbrella is detachable from the hands-free mechanism. In some implementations, the hands-free mechanism may be adjustable to accommodate a range of user sizes. In some aspects, the hands-free mechanism may comprise a harness. In some embodiments, the hands-free mechanism comprises straps may be configured to loop around a part of the user.

In some embodiments, the at least one stem may extend behind the user when the hands-free mechanism is worn. In some aspects, an angle of extension of the at least one stem is adjustable. In some implementations, the cover support structure may extend directly from one or both the at least one stem and the hands-free mechanism. In some aspects, the cover may be extendable over the user, wherein the extending unfolds the cover to at least partially cover the user. In some embodiments, the cover further may comprise handles that allow the user to extend the cover by pulling the handles. In some aspects, the handles may further allow the user to collapse the cover behind the user.

In some implementations, the at least one stem may extend vertically from the user when the hands-free mechanism is worn. In some aspects, the hands-free mechanism may comprise straps and the at least one stem extends from the straps. In some embodiments, the cover may further comprise a modular stem system that provides a plurality of stem position options for the at least one stem. In some aspects, the modular stem system may comprise a plurality of recesses of a shape and size to accept and secure the at least one stem. In some embodiments, placement of the at least one stem in the modular stem system may occur manually.

In some embodiments, the hands-free mechanism may comprise a base that is configured to anchor the hands-free responsive umbrella to a surface on which the base is placed. In some aspects, the cover may further comprise a modular stem system that provides a plurality of stem position options for the at least one stem. In some implementations, the modular stem system may comprise a plurality of recesses of a shape and size to accept and secure the at least one stem.

BRIEF DESCRIPTION OF THE DRAWINGS

The accompanying drawings, that are incorporated in and constitute a part of this specification, illustrate several embodiments of the disclosure and, together with the description, serve to explain the principles of the disclosure.

DETAILED DESCRIPTION

The present disclosure provides generally for a hands-free solution for use of a responsive umbrella. According to the present disclosure, a responsive umbrella with a hands-free mechanism allows a user to operate and hold the responsive umbrella without requiring the use of their hands. In some aspects, the hands-free mechanism may comprise a wearable strap or harness. In some embodiments, a responsive umbrella may be adjustable for the angle of extension from the hands-free mechanism, which may allow a user to adapt the responsive umbrella for different ambient conditions.

In the following sections, detailed descriptions of examples and methods of the disclosure will be given. The description of both preferred and alternative examples, though thorough, are exemplary only, and it is understood to those skilled in the art that variations, modifications, and alterations may be apparent. It is therefore to be understood that the examples do not limit the broadness of the aspects of the underlying disclosure as defined by the claims.

Glossary

Adjustable venue seating apparatus: as used herein refers to a device customized to be installed or used in conjunction with venue seating that may shield a user from one or more ambient conditions, such as sun exposure, wind, rain, light, or sound, as non-limiting examples, wherein the device may adjust based on the ambient conditions, such as through manual control, automatic detection and control, or pre-programmed responsiveness programmed by the user or manufacturer. In some embodiments, an adjustable venue seating apparatus may be installed individually on venue seating or in groups over sections or portions of the venue seating. In some aspects, adjustable venue seating may be customized to the specifications of the venue seating, wherein the adjustable aspects may be limited to allow for the enjoyment and safety of users of the adjustable venue seating apparatus and surrounding attendees.

Venue seating: as used herein refers to mass organized seating that tends to be static. As opposed to normal seating, there is a relationship between proximate seats and the uniformity and spacing between seats in front of, behind, and to the side of an attendee's seat. Venue seating accounts to this type of relational grouping when compared to normal seating.

Responsive umbrella: as used herein refers to any personal device that may shield a user from one or more ambient conditions, such as sun exposure, wind, rain, light, or sound, as non-limiting examples, wherein the device may adjust based on the ambient conditions, such as through manual control, automatic detection and control, or pre-programmed responsiveness programmed by the user or manufacturer.

Figure 1:
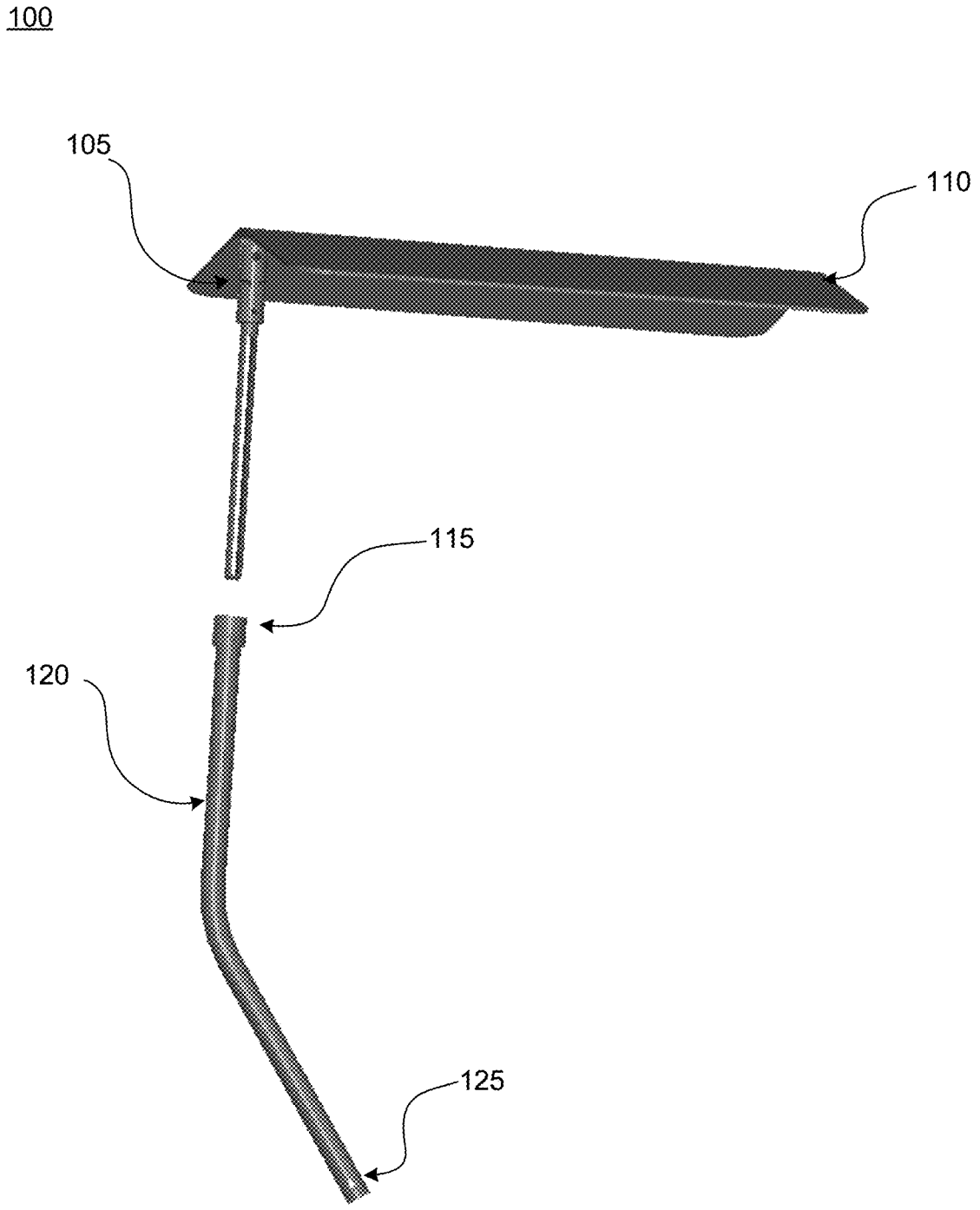
FIG. 1 illustrates an exemplary embodiment of an adjustable venue seating apparatus according to some embodiments of the present disclosure.

Referring now to FIG. 1, an exemplary adjustable venue seating apparatus 100 is illustrated. In some embodiments, an adjustable venue seating apparatus 100 may include an angle adjustment mechanism 105, a visor 110, a height adjustment mechanism 115, an arm 120, and an arm attachment mechanism 125. In some aspects, the height adjustment mechanism 115 may allow for vertical adjustment, such as for users of different heights. In some embodiments, the angle adjustment mechanism 105 may allow for one or both lateral and vertical angle adjustments. In some implementations, the angle adjustment mechanism 105 may allow for the tilting of the visor 110, such as to allow for the changing position of the sun. In some aspects, the angle adjustment mechanism 105 may allow for vertical angle adjustment, such as between a collapsed position and a default engaged position, wherein a collapsed position may comprise the visor 110 resting substantially parallel to the arm 120. In some embodiments, the range of vertical angle adjustment may be set by a venue, such as to protect the safety and viewing experience of nearby attendees.

In some implementations, an angle adjustment mechanism 105 may offer a range of motion for an attendee, which may allow for adjustment throughout an event based on the ambient conditions. In some aspects, an angle adjustment mechanism 105 may have a ball and socket to facilitate the range of motion. In some embodiments, an angle adjustment mechanism 105 may have a fixed range of motion. In some implementations, an angle adjustment mechanism 105 may click into specific angles for adjustments. In some aspects, an angle adjustment mechanism 105 may include a base and an insert. In some embodiments, an angle adjustment mechanism 105 may click into a base. In some implementations, an angle adjustment mechanism 105 may be installed into a base. In some aspects, an angle adjustment mechanism 105 may be attached to a visor 110. In some embodiments, an angle adjustment mechanism 105 may use a clevis fastener. In some implementations, an angle adjustment mechanism 105 may use a rivet to allow for a hinge design element.

In some embodiments, a visor 110 may be a flat surface. In some implementations, a visor 110 may be an angled surface. In some aspects, the shape of a visor 110 may be adjusted by an attendee. In some embodiments, the shape of a visor 110 may only be adjusted by a venue. In some implementations, a visor 110 may be contoured to a venue's specifications. In some aspects, a visor 110 may tilt in coordination with an angle adjustment mechanism 105. In some implementations, a visor 110 may be angled in accordance to any venue specifications, such as sightline requirements as a non-limiting example. In some embodiments, a visor 110 may be semi-rigid to allow for more flexibility.

In some implementations, a visor may connect to a hinge that allows it to move upwards and downwards. In some aspects, a visor 110 may move according to the needs of an attendee, such as wherein one or both the angle adjustment mechanism 105 and the height adjustment mechanism 115 may comprise a safety release function that may be responsive to an emergency condition. For example, an attendee may be at a sporting event. During the sporting event, an event may occur on the field where the venue's attendees all stand up in celebration. The emergency condition may be the sudden rise of the attendee, and the visor 110 may swing upwards to allow for that motion. Once the attendee sits back down, the visor 110 may return to the default engaged position or may fall into a collapsed state. In some embodiments, the tilt design may incorporate a titan screw to allow for tactile feedback. In some implementations, a ball plunge design may be used for the tilt design feature.

In some embodiments, a visor 110 may be made of a pliable, weatherproof, or durable material. By way of non-limiting examples, a visor 110 may be made of plastic optical fiber; thermoplastics such as polyethylene, polypropylene, polystyrene, or polyvinyl chloride; a material or alloy that allows for casting, such as aluminum casting; or materials that allow for an injection molding, such as metals, glasses, elastomers, confections, or polymers. In some implementations, a visor 110 may have rounded edges to enhance a material's low thermal capabilities.

In some embodiments, an adjustable venue seating apparatus 100 may include a height adjustment mechanism 115. In some implementations, a height adjustment mechanism 115 may connect to an angle adjustment mechanism 105. In some aspects, a height adjustment mechanism 115 may have a telescoping feature to adjust the adjustable venue seating apparatus 100 height range.

In some embodiments, an arm 120 may connect to a height adjustment mechanism 115. In some implementations, an arm 120 may support an adjustable venue seating apparatus 100. In some aspects, an arm attachment mechanism 125 may connect an arm 120 to a stable structure. For example, an arm 120 may connect to venue seating. In some embodiments, the adjustable venue seating apparatus 100 may comprise an adjustment toggle that may allow an attendee to manually adjust the settings, which may be one or both mechanical or electronic. As non-limiting examples, an adjustment toggle may comprise a bar, a button, a knob, a dial, or combinations thereof.

Figure 2A:
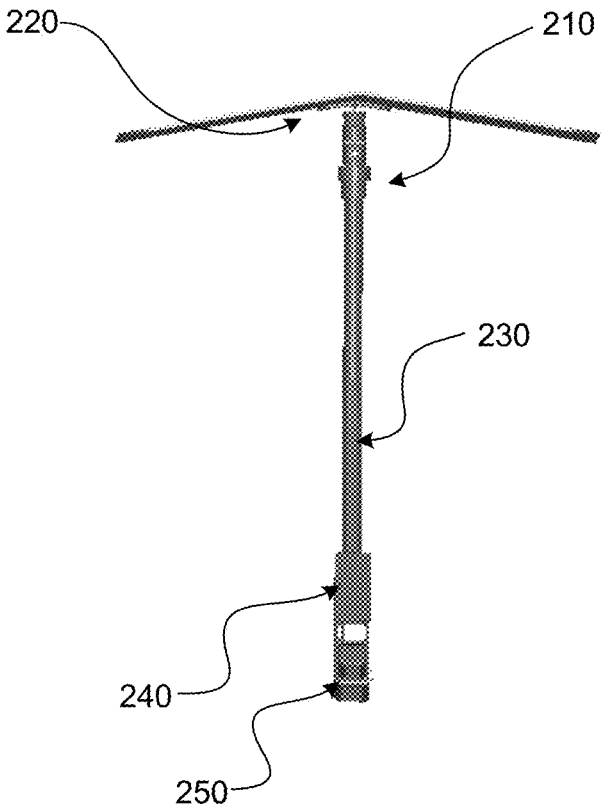
FIG. 2A illustrates a front view of an exemplary adjustable venue seating apparatus with a locking mechanism according to some embodiments of the present disclosure.
Figure 2B:
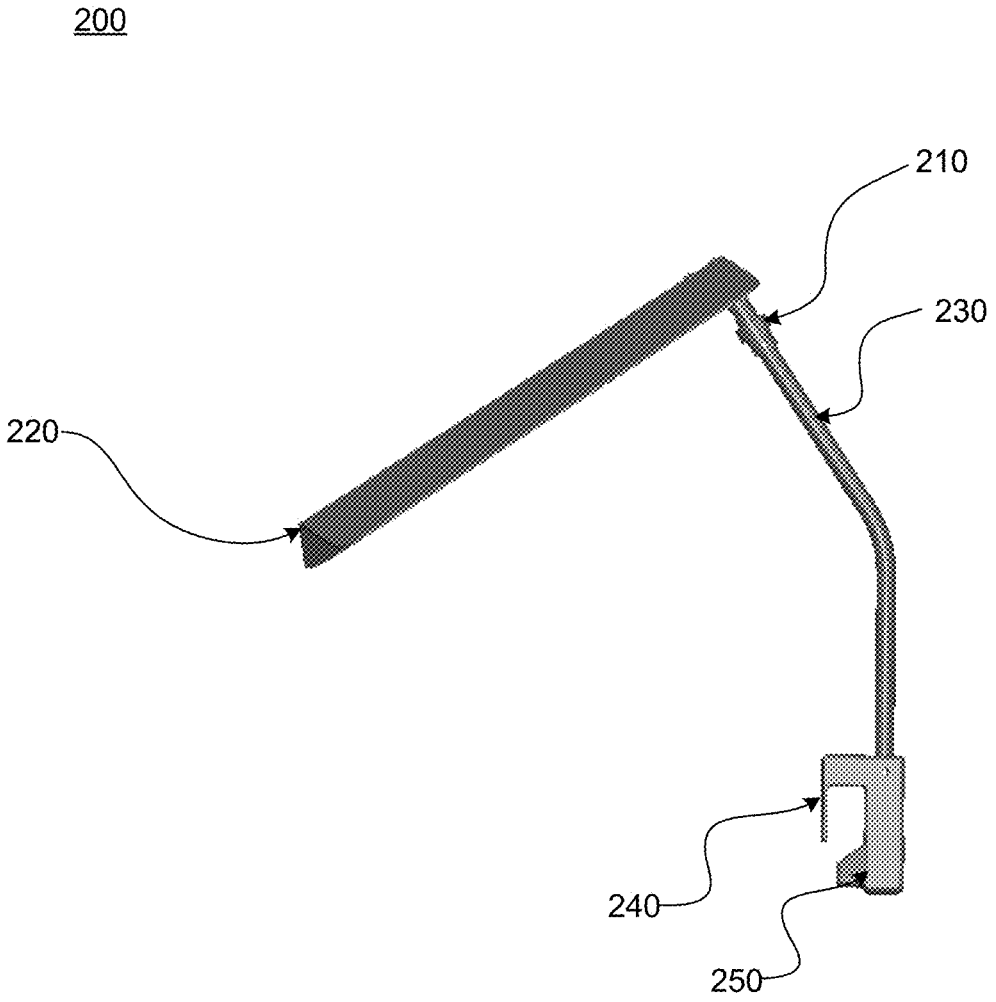
FIG. 2B illustrates a side view of an exemplary adjustable venue seating apparatus with a locking mechanism according to some embodiments of the present disclosure.

Referring now to FIGS. 2A-2B, an exemplary adjustable venue seating apparatus 200 with a locking mechanism 250 is illustrated. In some embodiments, an adjustable venue seating apparatus 200 may include an adjustment mechanism 210, a visor 220, an arm 230, an attachment mechanism 240, and a locking mechanism 250. In some aspects, the visor 220 may be collapsible, wherein the collapsing of the visor 220 may limit its ability to protect an attendee from the elements. For example, the visor 220 may comprise a tube that may contain a rolled material, wherein the rolled material may be extended and locked into place to engage the visor 220. In some embodiments, a collapsible visor 220 may allow for reduced impediment of visibility for surrounding attendees and an option where an attendee may disengage the adjustable venue seating apparatus 200. In some aspects, the visor 220 may comprise a safety release function, which may collapse the visor 220 when an emergency condition is detected.

In some implementations, an adjustment mechanism 210 may attach to a visor 220 and an arm 230. In some aspects, an adjustment mechanism 210 may have a ball and socket to facilitate the range of motion. In some embodiments, an adjustment mechanism 210 may have a fixed range of motion. In some implementations, an adjustment mechanism 210 may click into specific or preset angles. In some aspects, an adjustment mechanism 210 may include a base and an insert. In some embodiments, an adjustment mechanism 210 may click into a base. In some implementations, an adjustment mechanism 210 may be installed into a base. In some embodiments, an adjustment mechanism 210 may use a clevis fastener. In some implementations, an adjustment mechanism 210 may use a rivet to allow for a hinge design element.

In some aspects, a visor 220 may tilt in coordination with an adjustment mechanism 210. In some embodiments, the tilt design may incorporate a titan screw to allow for tactile feedback. In some implementations, a ball plunge design may be used for the tilt design feature. In some implementations, a visor 220 may be angled in accordance to any venue specifications, such as sightline requirements as a non-limiting example. In some embodiments, a visor 220 may be semi-rigid to allow for more flexibility.

In some implementations, an adjustment mechanism 210 may connect to an arm 230. In some implementations, an arm 230 may support an adjustable venue seating apparatus 200. In some aspects, an arm 230 may connect to a stable structure, like venue seating. In some embodiments, an arm 230 may connect to an attachment mechanism 240.

In some implementations, an attachment mechanism 240 may connect to a locking mechanism 250. In some aspects, a locking mechanism 250 may anchor an adjustable venue seating apparatus 200 into place. In some embodiments, a locking mechanism 250 may slide over venue seating. In some implementations, a locking mechanism 250 may click into place. In some aspects, a locking mechanism 250 may be permanently installed by a venue. In some embodiments, a locking mechanism 250 may use a key fob to be unlocked. In some implementations, a locking mechanism 250 may only be unlocked by a venue. In some aspects, a locking mechanism 250 may conform to venue seating as it is placed. In some embodiments, a locking mechanism 250 may be integrated into venue seating itself, with a separate adjustable venue seating apparatus, such as the one described in FIG. 1, installed into the locking mechanism 250. In some implementations, a locking mechanism 250 may be a holder for an adjustable venue seating apparatus 200.

Figure 3A:
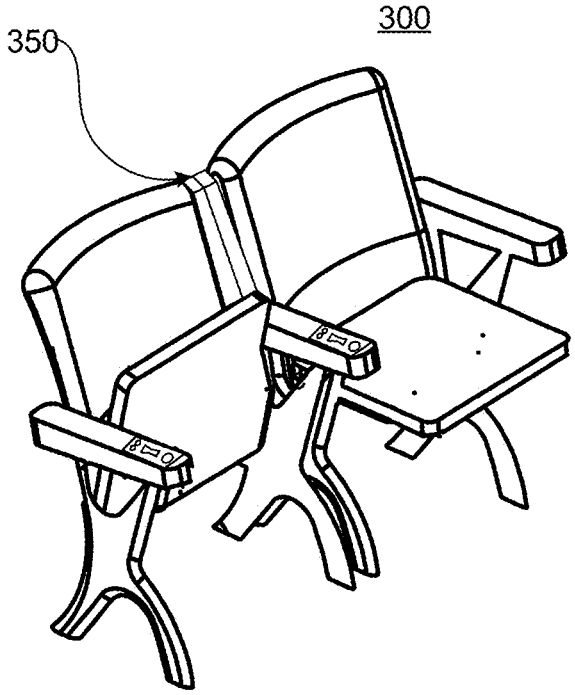
FIG. 3A illustrates venue seating with an exemplary adjustable seating apparatus pocket.
Figure 3B:
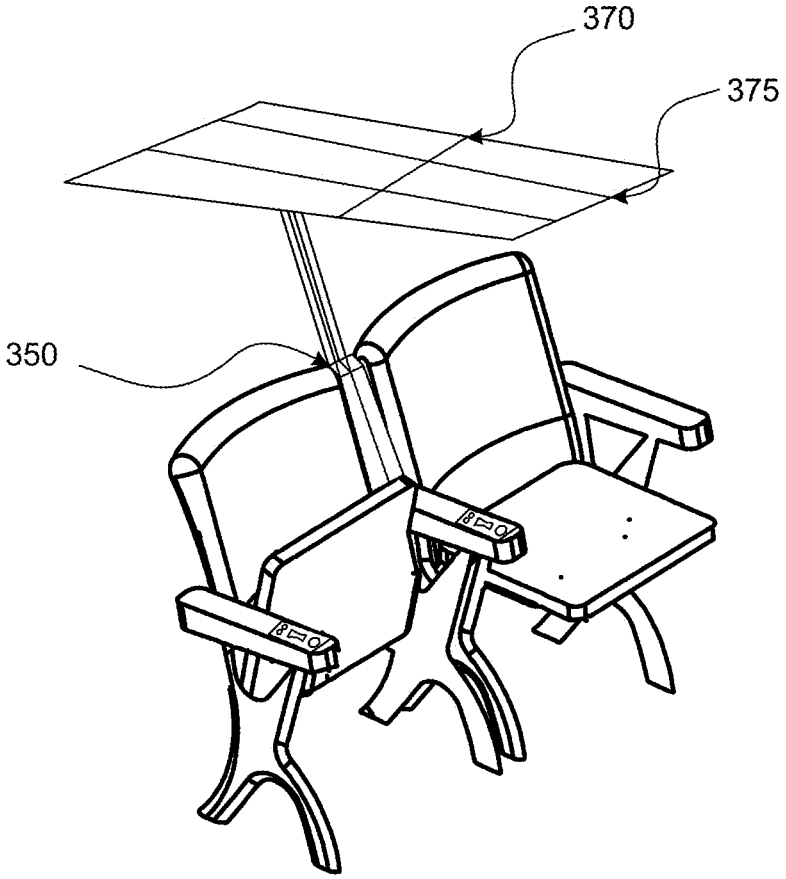
FIG. 3B illustrates venue seating with an exemplary adjustable seating apparatus.
Figure 3C:
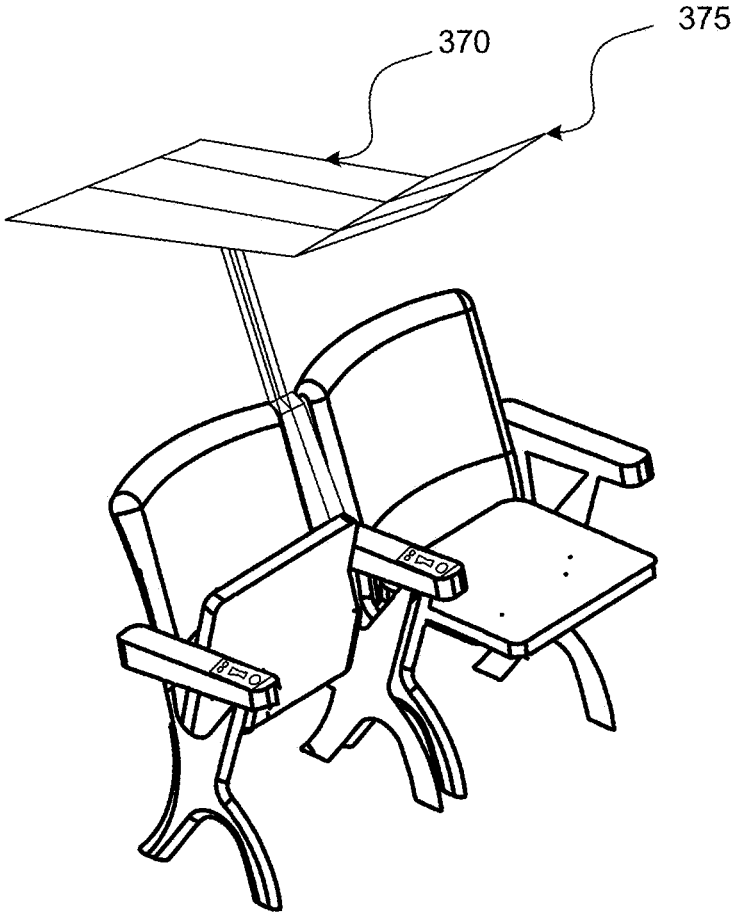
FIG. 3C illustrates venue seating with an exemplary adjustable seating apparatus with an adjustable flap.

Referring now to FIG. 3A-3C, venue seating 300 with an exemplary adjustable seating apparatus pocket 350, an exemplary adjustable seating apparatus 370, and an exemplary adjustable seating apparatus 370 with an adjustable flap 375, respectively, is illustrated. In some embodiments, venue seating 300 may include an adjustable seating apparatus pocket 350. In some implementations, venue seating 300 may include an exemplary adjustable seating apparatus 370. In some aspects, venue seating 300 may include an adjustable seating apparatus 370 with an adjustable flap 375. In some embodiments, venue seating 300 may include an adjustable seating apparatus pocket 350, an exemplary adjustable seating apparatus 370, and an adjustable flap 375. In some implementations, adjustable seating apparatus pocket 350, an exemplary adjustable seating apparatus 370, and an adjustable flap 375 may interact with one another.

In some aspects, an exemplary adjustable seating apparatus 370 with an adjustable flap 375 folds or collapses to limit water retention, whether from the elements, the venue, other patrons, or from some other source. In some implementations, an exemplary adjustable seating apparatus 370 may extend, collapse, fold, or adjust according to the weather, user input, venue input, or in response to action by a spectator, such as adjusting to a spectator's height. In some embodiments, the venue seating 300 may recognize proximate spectators, such as by sensors in the umbrella, sensors in the venue seating, being updated with information regarding ticket sales and to expect patrons in particular seats, or by manual inputs set by surrounding seats. In some aspects, venue seating 300 and its computational processing may be located at the base of the venue. In some embodiments, venue seating 300 and its computational processing may be contained or spread within the seating itself.

In some implementations, venue seating 300 may recognize or accept attributes of a spectator, such as height, whether the spectator is standing or sitting, where the spectator is with respect to a user's seating, and adjust based on these attributes to facilitate ease of viewing while accommodating the original user in the seat. In some aspects, a user may program the seating to account for spectators around them, or to respond to any requests from spectators about the venue seating, such as obscured vision. In some implementations, venue seating 300 may obtain its anticipated settings and information about seating from the venue itself, whether it originate from venue control operators, venue seating sensors, or programming that allows venue seating 300 to communicate with other venue seating. For example, if a spectator sits in a chair, the seat will then transmit information since it now senses weight in its place. Venue seating in front of this spectator may adjust and anticipate accordingly.

In some embodiments, venue seating 300 may adapt to optimize condition shielding within the venue, wherein all responsive umbrellas may operate in uniform. For example, each adjustable seating apparatus 370 may be acting as individual parts to a larger covering. In some implementations, venue seating 300 may be individually customized by a spectator who may have access to a seat control. In some aspects, venue seating 300 may be wirelessly controlled by a spectator, using controls provided by the venue, through an application on a smart device, or with a control kiosk controlling the venue seating 300, as non-limiting examples. In some embodiments, venue seating 300 may be controlled solely by the event organizer or by a venue operator, who may tailor settings according to the event, the attendees, the weather, need, or other variables they may have to consider during an event at a venue. In some implementations, a user may request particular settings to a venue for venue seating 300 ahead of time to accommodate their requests, such as for special needs settings.

In some embodiments, venue seating 300 may be in the form of a foldable, portable object (not pictured). In some implementations, the foldable object may come in three interconnected segments, including, but not limited to, a cushion, a back rest, and an adjustable responsive umbrella or covering. In some aspects, these segments may be adjusted based on venue need or user preference. In some implementations, a user may replace interconnected segments for others with different functionality or to more easily clean the segments.

In some embodiments, a responsive umbrella may be integrated in a seating adapter, wherein the responsive umbrella may be connected to or slipped over a portion of a seat for temporary and portable use. For example, the responsive umbrella may be integrated into a seat cushion that may be slipped over the back of a venue seat, wherein a user may pull out the responsive umbrella when needed. In some aspects, the responsive umbrella may hook into a portion of the venue seating allowing a user or venue to easily attach and detach the responsive umbrella. This flexibility may allow for quick response to a change in ambient condition and for quick fitting to meet customer demand.

For example, a venue may rent out the foldable object for use in their seating. The venue may have open lighting and at times be simultaneously bright due to sunlight while also being cold due to wind or weather. A user can then activate heating functionality in the foldable object to warm up while also adjusting the covering portion to protect from sunlight. In some embodiments, the covering segment may include a handle to adjust the covering itself. In some implementations, the covering segment may have solar powered functionality, such as functional fans to cool a user sitting in the sun. In some aspects, the foldable object may comprise a variety of materials, including, but not limited to plastics, nylon, rubber, silicone, aluminum, polymers, or microfiber.

Figure 4:
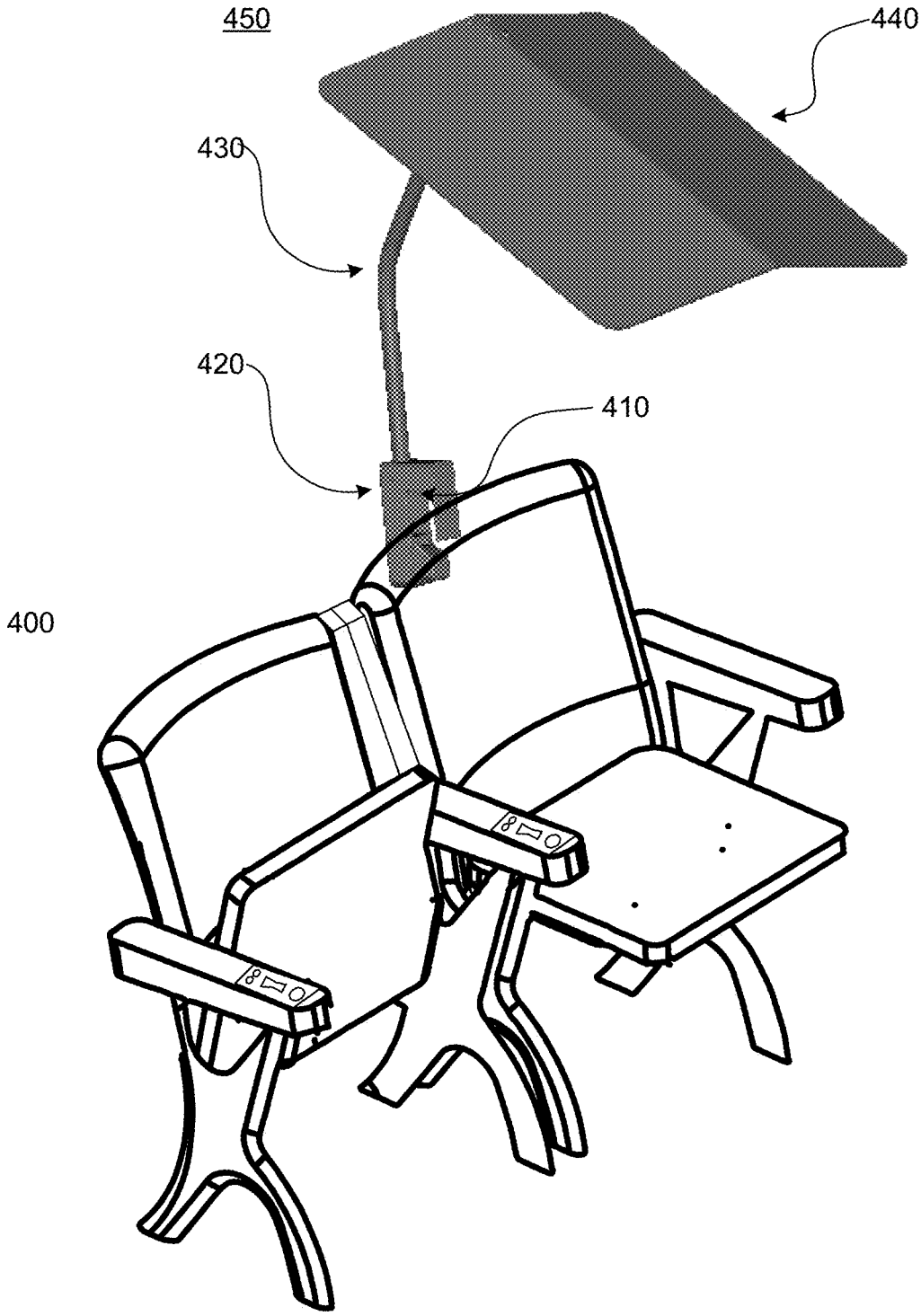
FIG. 4 illustrates venue seating with an exemplary adjustable seating apparatus with a locking mechanism.

Referring now to FIG. 4, venue seating 400 with an exemplary adjustable seating apparatus 450 with a locking mechanism 410 is shown. In some embodiments, an exemplary adjustable seating apparatus may include a locking mechanism 410, an attachment mechanism 420, an arm 430, and a visor 440. In some implementations, venue seating 400 may include an adjustable seating apparatus 450. In some aspects, venue seating 400 may include a locking mechanism 410 for an adjustable seating apparatus 450. In some embodiments, a locking mechanism 410 may be integrated into the venue seating 400 design. In some implementations, a locking mechanism 410 may be an attachment for venue seating 400.

In some aspects, venue seating 400 may allow for multiple adjustable seating apparatus 450 next to one another. In some embodiments, an adjustable seating apparatus 450 may be measured to fit within a single unit of venue seating 400. In some implementations, an adjustable seating apparatus 450 may restrict movement to fit within venue seating 400. In some aspects, an adjustable seating apparatus 450 may limit its height to not block those around the adjustable seating apparatus 450. In some embodiments, an adjustable seating apparatus 450 may restrict its range of motion to fit within venue seating 400 parameters.

Figure 5A:
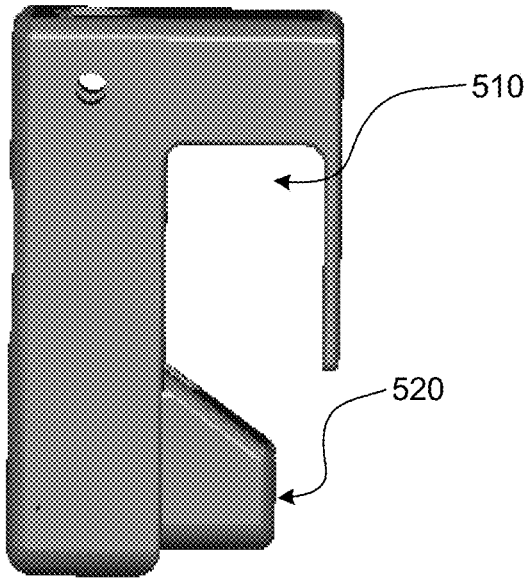
FIG. 5A illustrates a side view of an exemplary attachment mechanism with a lock.
Figure 5B:
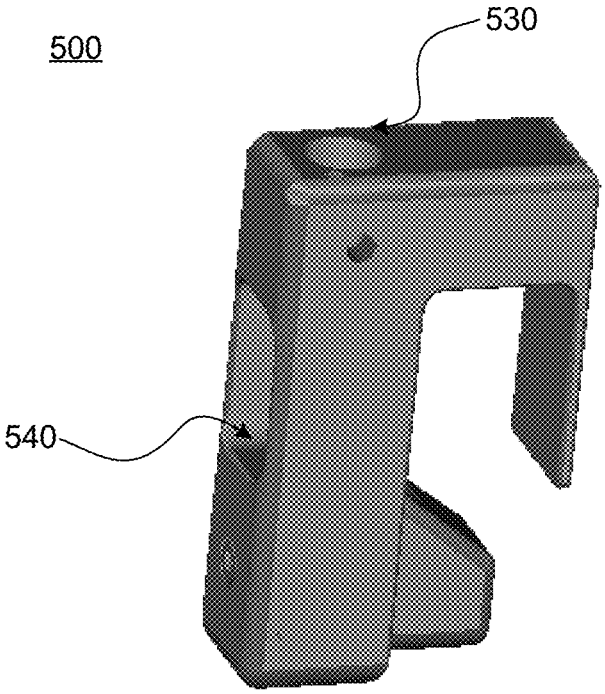
FIG. 5B illustrates a side view of an exemplary attachment mechanism with a lock.
Figure 5C:
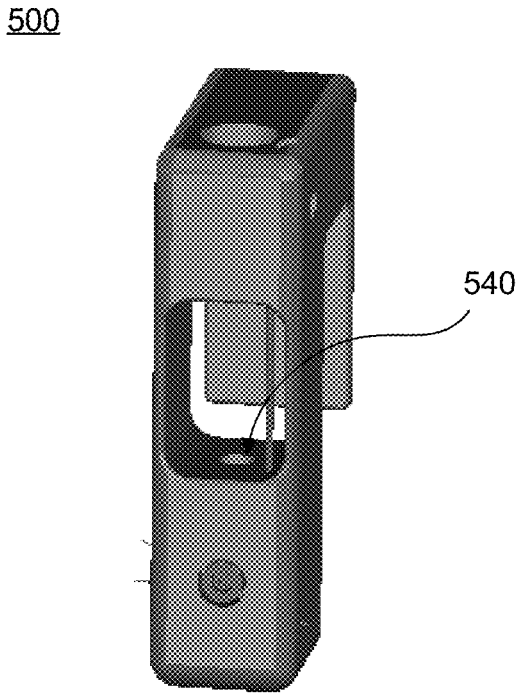
FIG. 5C illustrates a front view of an exemplary attachment mechanism with a lock.

Referring now to FIGS. 5A-5C, an exemplary attachment mechanism 500 with a lock is illustrated. In some embodiments, an attachment mechanism 500 may include a seat sleeve 510. In some implementations, an attachment mechanism 500 may include a securing mechanism 520. In some aspects, an attachment mechanism 500 may include an arm receiver 530. In some embodiments, an attachment mechanism 500 may include a lock release mechanism 540.

In some implementations, an attachment mechanism 500 may connect to an arm through an arm receiver 530 as described above. In some aspects, an attachment mechanism 500 may slide into venue seating. In some embodiments, a securing mechanism 520 may retract during installation. In some implementations, a securing mechanism 520 may click into place to indicate installation. In some embodiments, a securing mechanism 520 may be pulled or pushed to be engaged. In some aspects, a lock release mechanism 540 may require a key to disengage.

In some implementations, the lock release mechanism 540 may be mechanical. For example, the lock release mechanism 540 may comprise a magnetic mechanism, wherein a key may be magnetic and at least a portion of the lock release mechanism 540 may comprise a metal that the magnetic key may disengage to release the adjustable seating apparatus from the venue seating. In some aspects, the lock release mechanism 540 may be electronic.

Figure 6A:
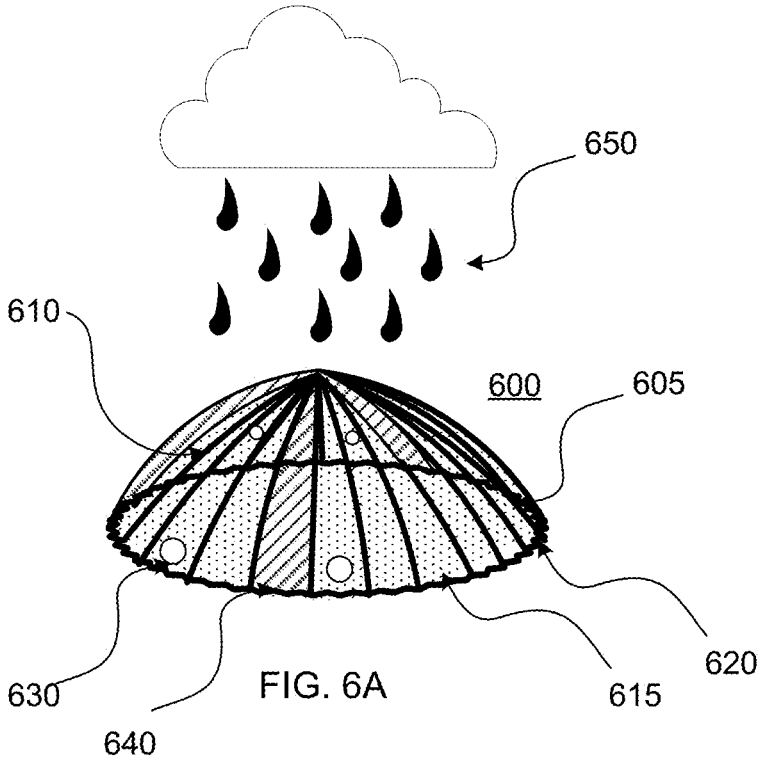
FIG. 6A illustrates an exemplary embodiment of a responsive umbrella according to some embodiments of the present invention.
Figure 6B:
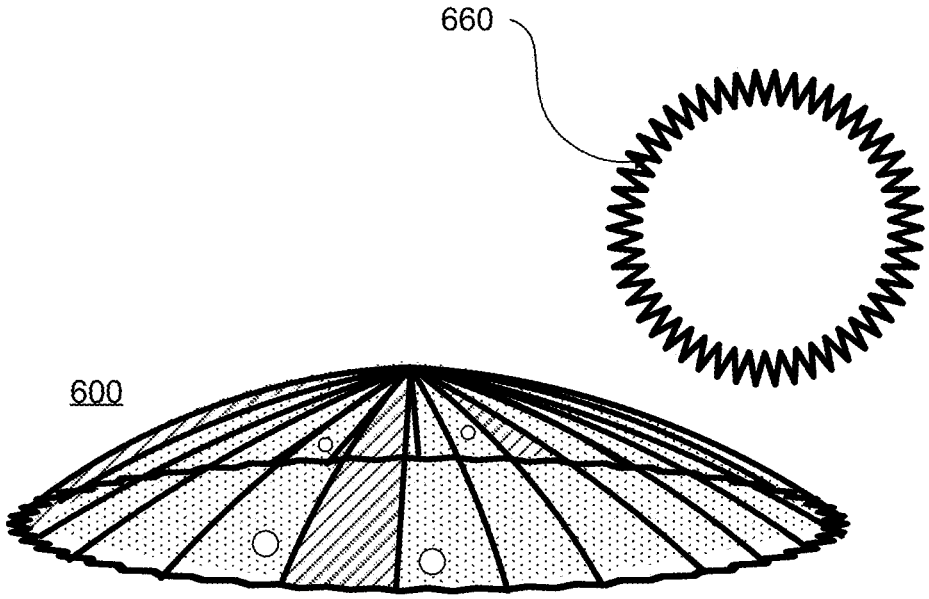
FIG. 6B illustrates an exemplary embodiment of a responsive umbrella according to some embodiments of the present invention.
Figure 6C:
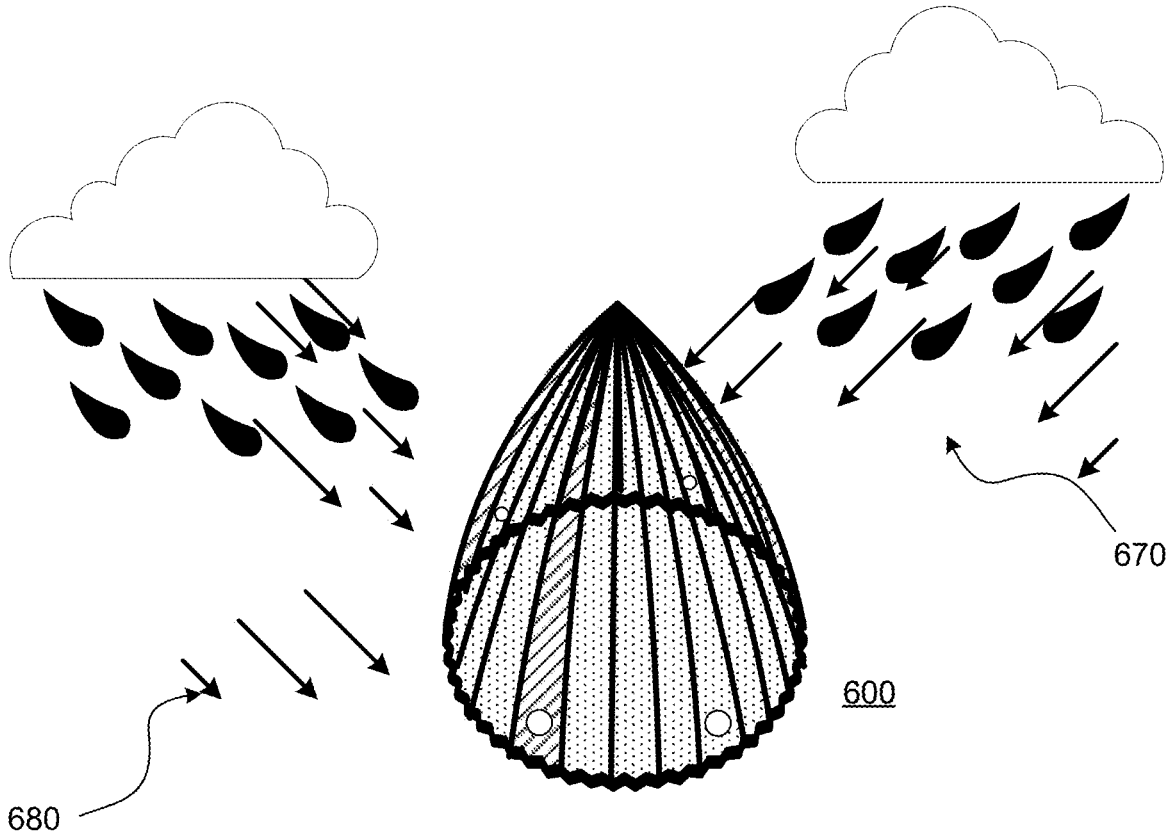
FIG. 6C illustrates an exemplary embodiment of a responsive umbrella according to some embodiments of the present invention.

Referring now to FIGS. 6A-6C, an exemplary responsive umbrella 600 is illustrated. In some aspects, a responsive umbrella 600 may comprise flexible and extendable ribs 610, wherein the ribs 610 may maintain a range of shapes and configurations. In some embodiments, the responsive umbrella 600 may comprise a flexible and expandable outer rim 605, wherein the outer rim 605 may maintain a range of shapes and configurations. In some aspects, the ribs 610 may comprise a variety of materials, including, but not limited to, metal, steel, wood, plastics, polymers, rubber, silicone, or aluminum.

In some implementations, the responsive umbrella 600 may comprise a flexible covering 615, wherein the covering 615 may be at least partially controlled by one or both the outer rim 605 and the ribs 610. In some aspects, the flexible covering 615 may comprise a variety of materials, including, but not limited to, plastics, nylon, rubber, silicone, aluminum, polymers, or microfiber. In some embodiments, the ribs 610 may be integrated into the covering 615, wherein the covering 615 between each rib 610 may form a panel 620. For example, the covering 615 may comprise a series of pockets that may house the ribs 610 or the ribs 610 may be manufactured into the material of the covering 615, such as through adhesion, welding, or other connective mechanisms.

In some aspects, one or more of the ribs 610 or panels 620 may comprise sensors 630 to detect predefined ambient conditions, such as, for example, rain, heat, humidity, UV rays, or wind. In some implementations, one or more the ribs 610 or panels 620 may comprise sensors 630 or communication protocols, such as near-field communications, to respond or react to other objects in close proximity and interact accordingly. For example, a user walking with a responsive umbrella may enter a subway, wherein the responsive umbrella collapses or shrinks to reduce its size in a confined place with a low ceiling. In some aspects, one or more panels may comprise an energy panel 640, wherein the energy panel 640 may collect power from ambient conditions, such as wind, solar, or thermal.

In some embodiments, panel appearance may be adjustable. As an illustrative example, the transparency level of one or more of the panel may be adjustable, such as based on ambient light levels or user settings. For example, where the ambient light levels are low, such as during a storm, the panel may be more transparent to allow for more light. In some aspects, the color of one or more panel may be adjustable, such as based on predefined ambient conditions or user settings. In some implementations, certain colors may provide additional functionality. For example, in hot weather, a panel may have a white exterior to reflect light and a black interior to more effectively absorb some of the heat and limit light permeation. In colder weather, the panels may be reversed or pivoted to harness or give the sensation or perception of maximizing heat. In some aspects, the color or colors may be adjustable.

In some aspects, such as illustrated in FIG. 6A, the responsive umbrella 600 may maintain a traditional umbrella configuration during rainfall 650 with little wind, where the primary functional requirement of the responsive umbrella 600 may be to shield a user from rain that may be generally perpendicular to the ground. In some embodiments, such as illustrated in FIG. 6B, the responsive umbrella 600 may extend to have a long diameter and shallow depth, where the primary functional requirement of the responsive umbrella 600 may be to limit sun 660 and heat exposure. The extended diameter may maximize protection but may be susceptible to other ambient conditions, such as wind or directional rain.

In some embodiments, such as illustrated in FIG. 6C, the responsive umbrella 600 may form a bubble-like configuration, wherein the outer rim may have a reduced diameter and may extend over the user. The covering 615 of the responsive umbrella 600 may surround the user limiting exposure to wind 680 and directional precipitation 670, such as rain, snow, or hail. The bubble-like configuration may limit the effect of strong ambient conditions on the functionality of the responsive umbrella 600.

For example, traditional umbrellas may be susceptible to winds that may tear the panels or flip the covering, which may damage one or more the ribs, panels, and coverings. In some aspects, one or more of the ribs 610 and the outer rim 605 may comprise a flexible material, such as plastic, rubber, or silicone, wherein the flexibility may allow for a wider tolerance range than would other rigid or less flexible materials. In some aspects, the flexible material may limit the chance of attracting lightning.

Figure 7:
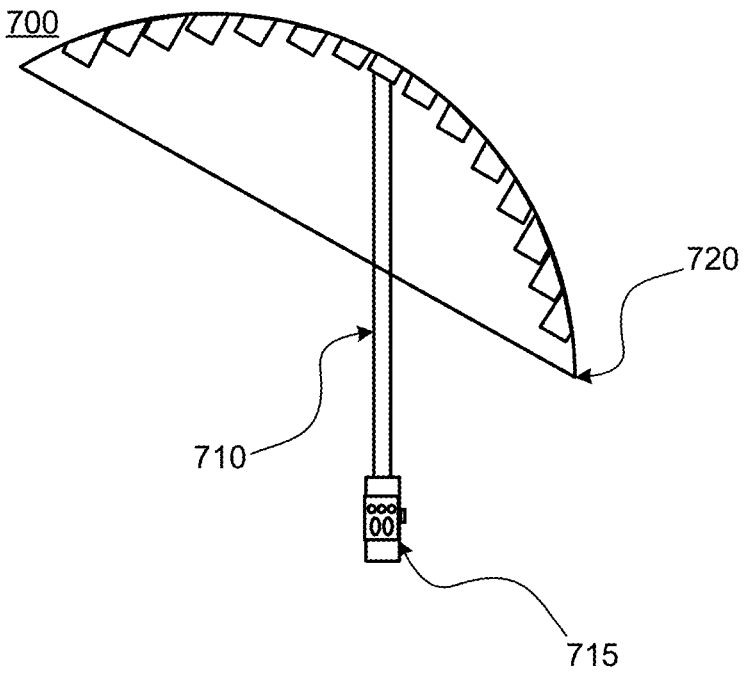
FIG. 7 illustrates an exemplary embodiment of a responsive umbrella with personal stem according to some embodiments of the present invention.

Referring now to FIG. 7, an exemplary responsive umbrella 700 with personal stem 710 is illustrated. In some aspects, the responsive umbrella 700 may appear similar to a traditional umbrella, wherein a personal stem 710 may extend from the center of the covering 720. In some embodiments, the personal stem 710 may comprise an operating pad 715, wherein a user may control at least a portion of the functionality of the responsive umbrella 700. For example, the operating pad 715 may allow a user to toggle the responsive umbrella 700 open and close or off and on, wherein the responsive umbrella 700 may be set to function without responsiveness. In some aspects, the operating pad 715 may allow a user to customize the functionality or manually configure responsive settings.

In some aspects, the operating pad 715 may comprise a display interface. In some embodiments, the operating pad 715 may wirelessly communicate with external devices, such as a smartphone, tablet, or desktop computer. In some implementations, the responsive settings may evolve over time based on analysis of data over time, allowing the responsive umbrella 700 to become more effective. For example, the responsive umbrella 700 may be pre-programmed with default settings for pre-defined conditions, and the user may adjust the settings based on preference or other variables. For example, the settings for a responsive umbrella 700 may be based on an average person with average height and weight and without secondary attributes, such as occupational conditions or ambient population density. If the user changes certain programming or settings, a responsive umbrella 700 may adjust accordingly in the future before the user reinitiates its settings, or it adapts according to certain environments or settings as defined by the user's previously set preferences. Over time, if a user continues to engage these settings consistently, the responsive umbrella 700 may adjust automatically.

In some embodiments, preferences and configurations may be linked to a profile or a user tab on a responsive umbrella 700. In some aspects, if preferences are linked to a profile, a responsive umbrella 700 may sense which user's smartphone is in proximity and link to that device. In some implementations, a user may select which profile to apply for a particular use, such as when a user loans a responsive umbrella 700 to a friend. In some embodiments, a responsive umbrella 700 may allow for multiple users, such as family members or employees in a construction company. In some aspects, a profile saved on a phone may be transferred and pre-programmed based on a prior profile when a new responsive umbrella 700 is activated. In some embodiments, a responsive umbrella 700 may be paired with global positioning system (GPS) technology to enable a user to locate a responsive umbrella 700 in situations where it may be lost or left behind.

Figure 8:
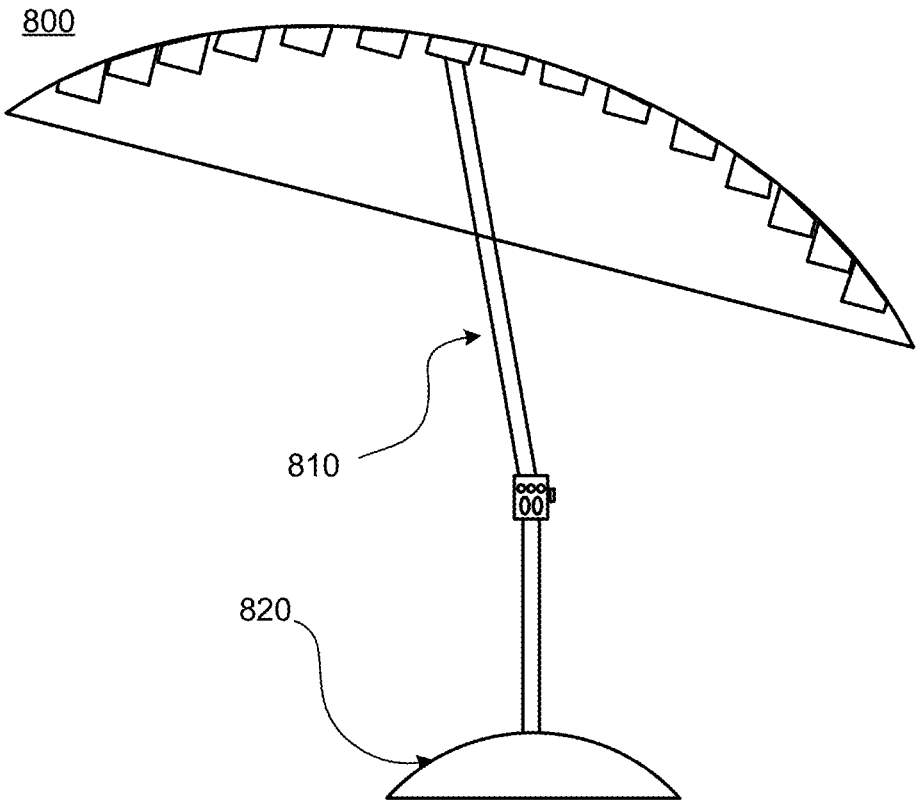
FIG. 8 illustrates an exemplary embodiment of a responsive umbrella with an adaptive stem.

Referring now to FIG. 8, an exemplary responsive umbrella 800 with an adaptive stem 810 is illustrated. In some aspects, a responsive umbrella 800 may be sized for a plurality of uses, such as a beach umbrella, a patio umbrella, or other group umbrellas. In some aspects, the functionality may be the same or similar to a personal responsive umbrella 800. In some embodiments, a responsive umbrella 800 may be adaptable between personal and group use. In some implementations, a personal stem may be replaced by a stabilizing stem, which may comprise a base 820 that may allow the responsive umbrella 800 to stand upright and anchor the responsive umbrella 800 to a surface. In some aspects, such as with a beach stem, the stabilizing stem may comprise a pointed tip that may easily penetrate sand or dirt. In some embodiments, the stabilizing stem may comprise other stabilizing mechanisms, such as extenders that may expand radially into the ground or a weighted portion. In some implementations, the responsive umbrella 800 may expand and contract to be a personal umbrella and a group umbrella, wherein one or more the outer rim, panels, ribs, or covering may be extendable.

In some aspects, a user may program settings, through an item like a smart device or a responsive umbrella 800, for multi-use purposes. For example, if a user wants to change a responsive umbrella 800 from personal use to group use, they may choose an option for the responsive umbrella 800 to adjust to while preparing the adaptive stem 810 for the new use. In some embodiments, a user will be able to program both a responsive umbrella and an adaptive stem 810 for a variety of uses and have them adjust themselves accordingly without physical interaction from the user.

Figure 9:
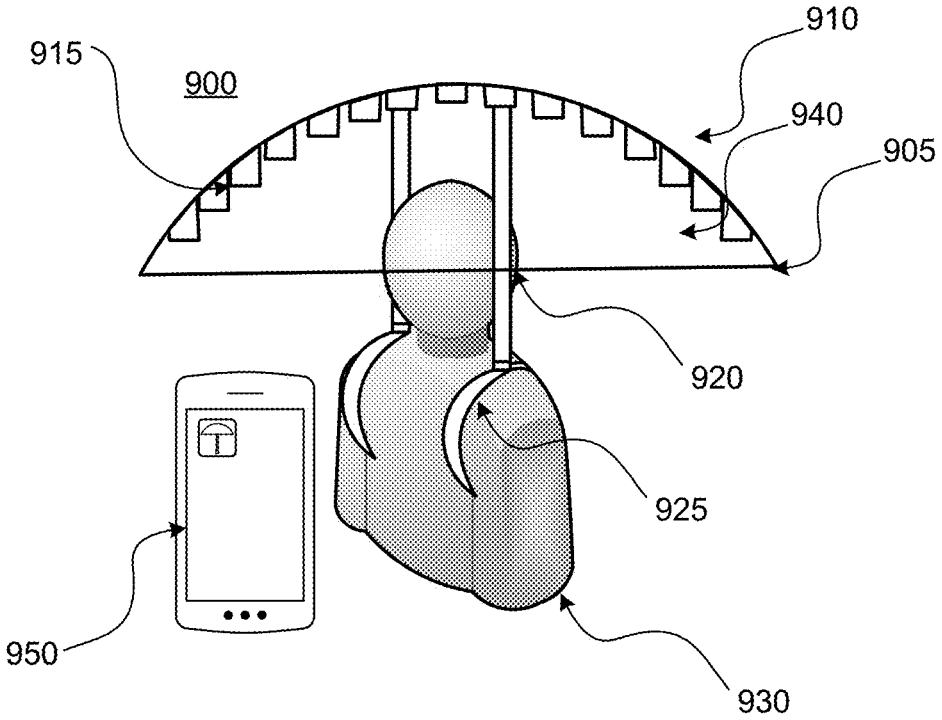
FIG. 9 illustrates an exemplary embodiment of a responsive umbrella with a modular stem system.

Referring now to FIG. 9, a perspective view of an exemplary responsive umbrella 900 with a modular stem system 910, wherein the modular stem system 910 comprises one or more stem slots 915 configured to accept one or more stems 920. In some embodiments, the responsive umbrella 900 may comprise a cover 940 that may shield at least a portion of ambient elements for a user. In some implementations, the cover 940 may maintain its shape through a cover support structure 905 that may provide some rigidity to the cover 940, such as a collapsible ring comprising pieces of rigid material that may connect when the cover 940 is expanded. In some embodiments, the modular stem system 910 may contribute to maintaining the structure and shape of an expanded cover 940. In some aspects, the cover support structure 905 may comprise a rigid or semi-rigid material, such as a plastic, metal, or reinforced fabric.

In some aspects, the modular stem system 910 may allow a user 930 to customize how the responsive umbrella 900 may be held. For example, a responsive umbrella 900 may be held in a traditional format when a single stem 920 may be inserted into a center slot. In some aspects, a user 930 may prefer a hands-free responsive umbrella 900, such as when she is performing an activity that may require use of both hands. In some embodiments, one or more stems 920 may comprise a hands-free mechanism, such as shoulder or neck straps 925 or a harness. For example, two stems 920 with shoulder straps 925 may be inserted to separate stem slots 915 based on the width of the user's shoulders. In some implementations, straps 925 may comprise hook and loop fasteners, magnets, magnetic tape, synthetics, or other adhesive materials, as non-limiting examples.

In some aspects, a modular stem system 910 may be wirelessly paired, such as through an application on a portable smart device 950, with a common object (not shown), such as a handbag, so that a responsive umbrella 900 may connect to it. In some implementations, a modular stem system 910 may allow for different forms of wirelessly activating a responsive umbrella 900, such as hands-free activation, voice or sound activation, digital activation, or movement activation, as non-limiting examples. For example, as previously discussed, a wireless component may be inserted into a handbag to allow a user to use a hands-free responsive umbrella 900 wherein the covering itself may be activate by a user's chin. In some embodiments, a responsive umbrella 900 may attach to an occupational uniform item, such as a vest, belt, or safety sash, as non-limiting examples.

Figure 10A:
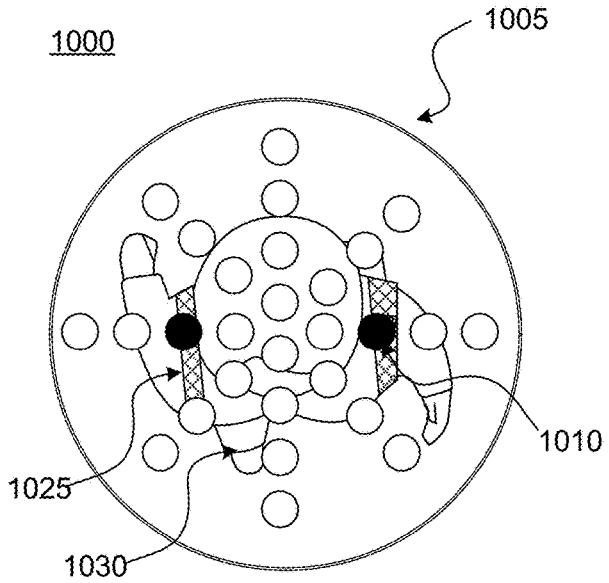
FIG. 10A illustrates a top down view of an exemplary responsive umbrella with a modular stem system, wherein the modular stem system comprises one or more stem slots configured to accept one or more stems.

Referring now to FIG. 10A, a top down view of an exemplary responsive umbrella 1000 with a modular stem system 1010 and hands-free mechanism 1025 is illustrated, wherein the modular stem system 1010 may comprise one or more stem slots configured to accept one or more stems 1020. In some embodiments, a responsive umbrella 1000 may comprise a modular stem system 1010 that may allow for different stem position options for a stem extending from the responsive umbrella 1000. In some aspects, the modular stem system 1010 may comprise a plurality of recesses of a shape and size to accept and secure the stem or stems. In some implementations, the stem position may determine the orientation of the cover 1040.

Figure 10B:
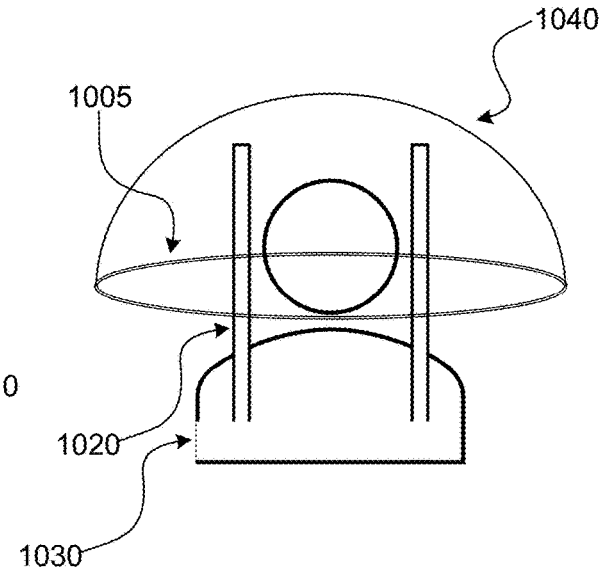
FIG. 10B illustrates a front view of an exemplary responsive umbrella with a modular stem system, wherein the modular stem system comprises one or more stem slots configured to accept one or more stems.

Referring now to FIG. 10B, a front view of an exemplary responsive umbrella 1000 with a modular stem system 1010 is illustrated, wherein the modular stem system 1010 may comprise one or more stem slots (not shown to simplify the view) configured to accept one or more stems 1020. In some aspects, placing the stems 1020 in a central position, the cover 1040 may be oriented to be directly over the user 1030. In some embodiments, the responsive umbrella 1000 may comprise a cover 1040 that may shield at least a portion of ambient elements for a user. In some implementations, the cover 1040 may maintain its shape through a cover support structure 1005, such as a collapsible ring comprising pieces of rigid material that may connect when the cover 1040 is expanded. In some embodiments, the modular stem system 1010 may contribute to maintaining the structure and shape of an expanded cover 1040.

Figure 11A:
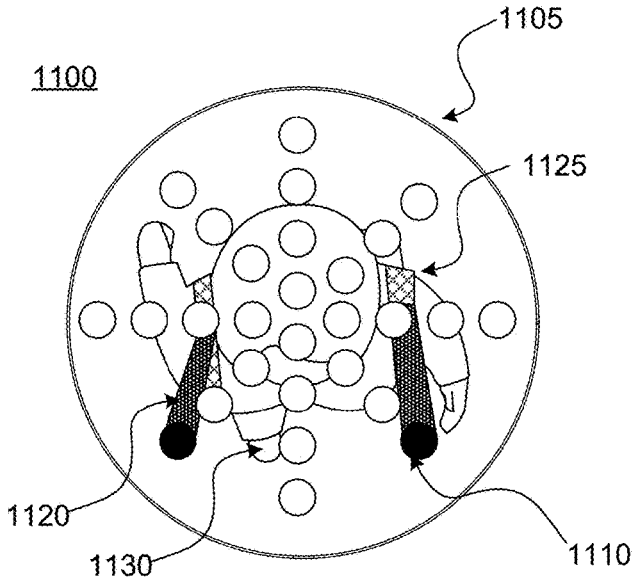
FIG. 11A illustrates a top down view of an exemplary responsive umbrella with a modular stem system, wherein the modular stem system comprises one or more stem slots configured to accept one or more stems.

Referring now to FIG. 11A, a top down view of an exemplary responsive umbrella 1100 with a modular stem system 1110 and hands-free mechanism 1125 is illustrated, wherein the modular stem system 1110 may comprise one or more stem slots configured to accept one or more stems 1120. In some embodiments, a responsive umbrella 1100 may comprise a modular stem system 1110 that may allow for different stem position options for a stem extending from the responsive umbrella 1100. In some aspects, the modular stem system 1110 may comprise a plurality of recesses of a shape and size to accept and secure the stem or stems. In some implementations, the stem position may determine the orientation of the cover 1140.

Figure 11B:
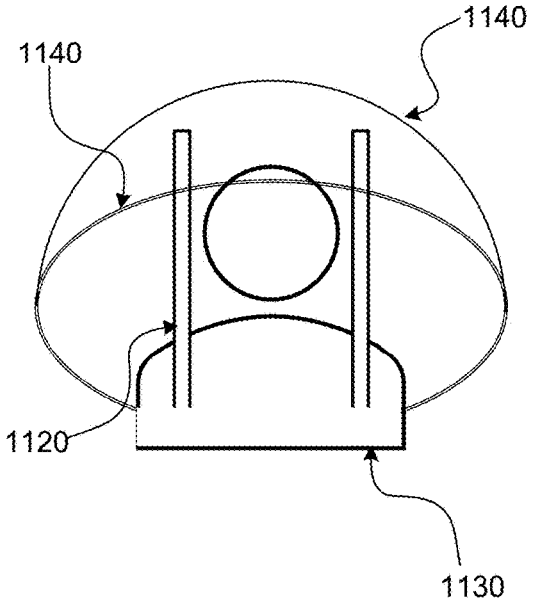
FIG. 11B illustrates a front view of an exemplary responsive umbrella with a modular stem system, wherein the modular stem system comprises one or more stem slots configured to accept one or more stems.
Figure 12A:
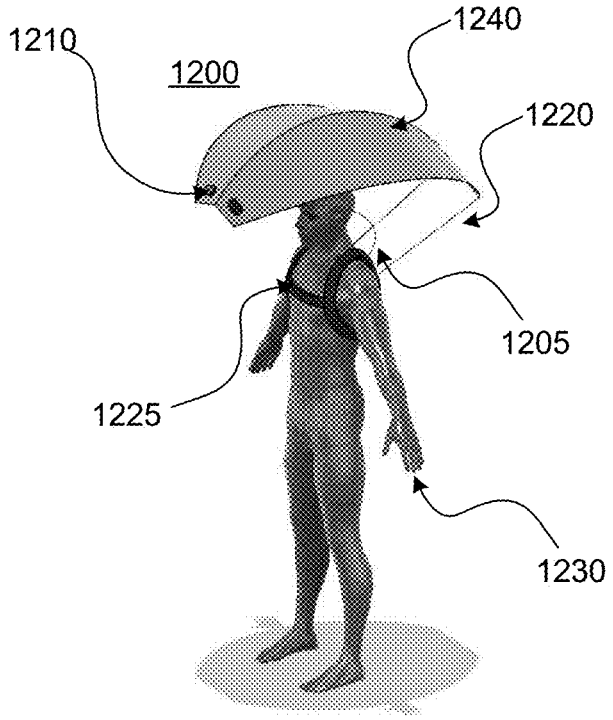
FIG. 12A illustrates a perspective view of an expanded orientation of an exemplary responsive umbrella with hands-free mechanism as worn by a user.
Figure 12B:
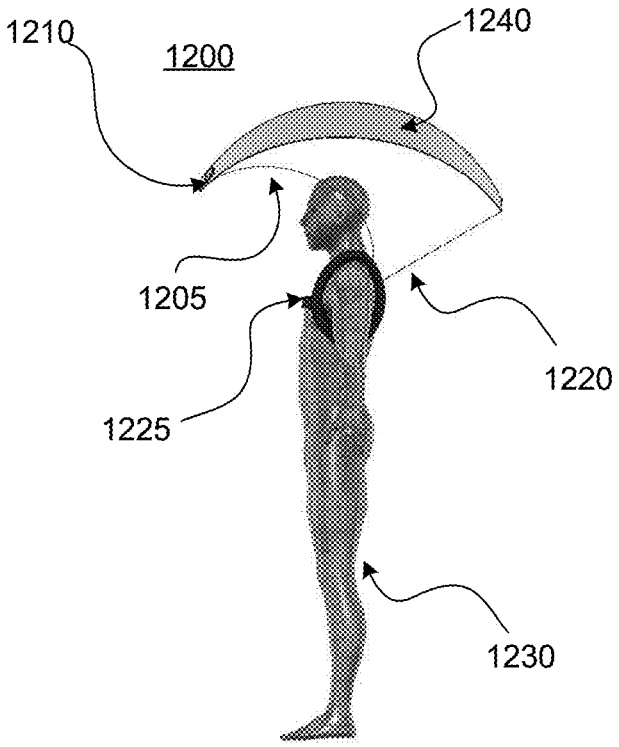
FIG. 12B illustrates a side view of an expanded orientation of an exemplary responsive umbrella with hands-free mechanism as worn by a user.
Figure 12C:
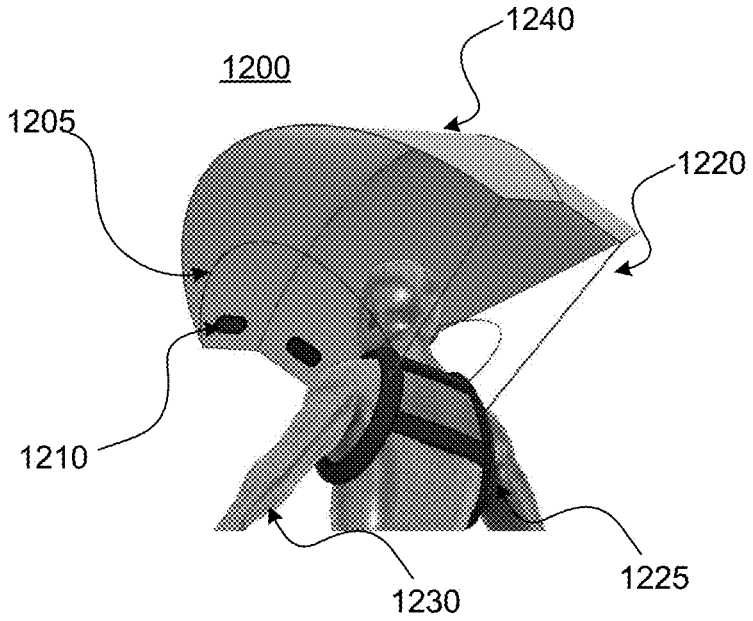
FIG. 12C illustrates a back view of an expanded orientation of an exemplary responsive umbrella with hands-free mechanism as worn by a user.
Figure 12D:
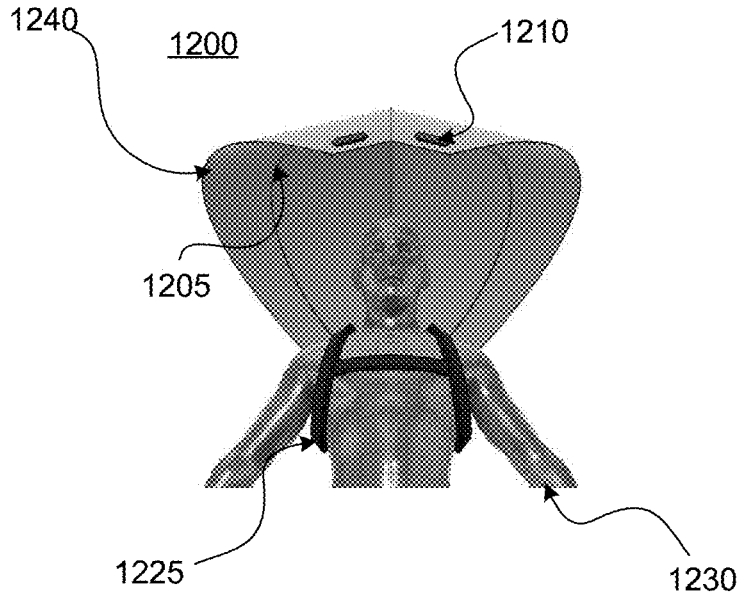
FIG. 12D illustrates a front view of an expanded orientation of an exemplary responsive umbrella with hands-free mechanism as worn by a user.

Referring now to FIG. 11B, a front view of an exemplary responsive umbrella 1100 with a modular stem system 1110, wherein the modular stem system 1110 may comprise one or more stem slots (not shown to simplify the view) configured to accept one or more stems 1120. In some aspects, placing the stems 1120 in a forward position, the cover 1140 may be oriented to tilt behind the user 1130, which may be useful where the ambient conditions may affect the user's back or where the user 1130 may prefer a wider range of vision, such as while walking or working.

In some embodiments, the responsive umbrella 1100 may comprise a cover 1040 that may shield at least a portion of ambient elements for a user 1130. In some implementations, the cover 1140 may maintain its shape through a cover support structure 1105, such as a collapsible ring comprising pieces of rigid material that may connect when the cover 1140 is expanded. In some embodiments, the modular stem system 1110 may contribute to maintaining the structure and shape of an expanded cover 1140.

Referring now to FIGS. 12A-12D, various views of an expanded configuration of an exemplary responsive umbrella 1200 with hands-free mechanism 1225 is illustrated as worn by a user 1230. In some aspects, a responsive umbrella 1200 may comprise a cover 1240 that may shield at least a portion of ambient elements for a user 1230. In some implementations, a responsive umbrella 1200 may be lightweight and useful to wear to limit sun exposure. In some aspects, the responsive umbrella 1200 may comprise a sturdier construction, which may be preferable in harsher conditions, such as wind, rain, and snow.

In some embodiments, the responsive umbrella 1200 may comprise one or more stems 1220 that may extend behind the user 1230, which may keep the stems 1220 from limiting mobility of the user 1230. In some aspects, the angle of extension may be adjustable, such as based on user size or preferences. In some implementations, the cover 1240 may extend from the one or more stems 1220 over the user 1230, such as by pulling on handles 1210 located on the cover 1240. In some aspects, cover support structures 1205 may be anchored on a hands-free mechanism 1225, such as a harness, straps, belts, backpack, or other wearable device. In some aspects, the hands-free mechanism 1225 may be adjustable, such as to accommodate a range of user sizes. In some implementations, the hands-free mechanism 1225 may be available in a range of sizes.

In an extended orientation, the cover support structures 1205 may push the cover 1240 forward so that the material is taut and stable from extension from the one or more stems 1220. In some embodiments, one or more of the cover support structures 1205 and one or more stems 1220 may be activated to trigger the extended orientation, such as through an internal spring system, telescoping system, or release of tension in a folded position, as non-limiting examples. In some aspects, the cover support structures 1205 may comprise a central spine that may provide structure over the user 1230.

Figure 13A:
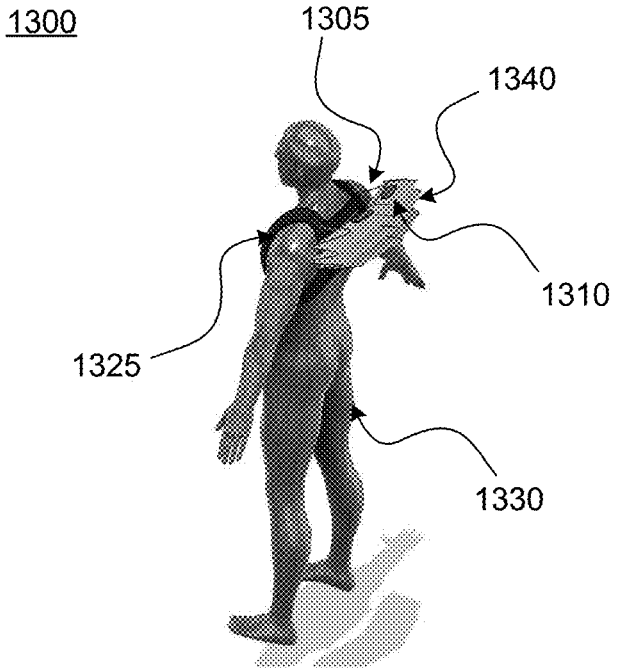
FIG. 13A illustrates a back perspective view of a collapsed orientation of an exemplary responsive umbrella with hands-free mechanism as worn by a user.
Figure 13B:
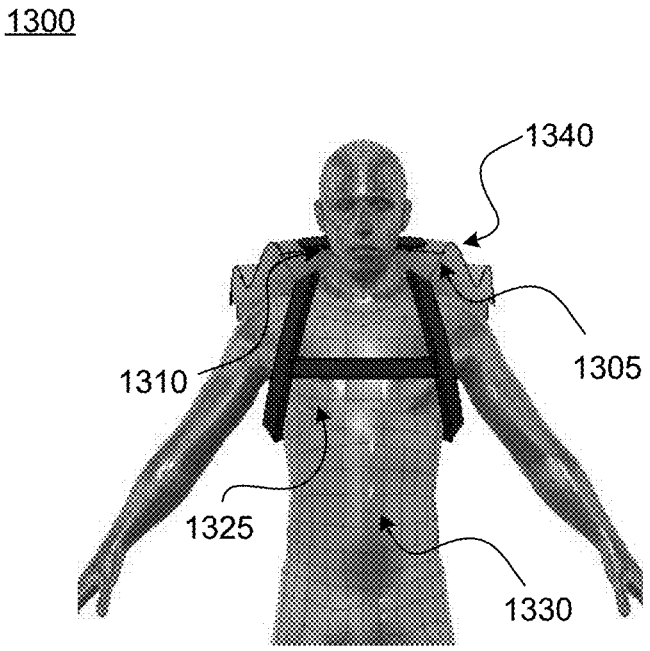
FIG. 13B illustrates a front view of a collapsed orientation of an exemplary responsive umbrella with hands-free mechanism as worn by a user.
Figure 13C:
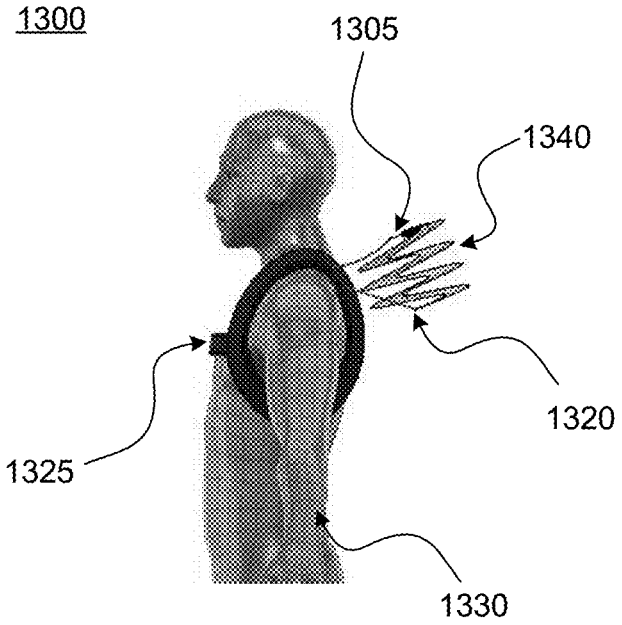
FIG. 13C illustrates a side view of a collapsed orientation of an exemplary responsive umbrella with hands-free mechanism as worn by a user.

Referring now to FIGS. 13A-13C, various views of a collapsed configuration of an exemplary responsive umbrella 1300 with hands-free mechanism 1325 is illustrated as worn by a user 1330. In some aspects, a responsive umbrella 1300 may comprise a cover 1340 that may shield at least a portion of ambient elements for a user 1330. In some embodiments, the responsive umbrella 1300 may comprise one or more stems 1320 that may extend behind the user 1330, which may keep the stems 1320 from limiting mobility of the user 1330. In some implementations, the cover 1340 may extend from the one or more stems 1320 over the user 1330, such as by pulling on handles 1310 located on the cover 1340. In some aspects, cover support structures 1305 may be anchored on a hands-free mechanism 1325, such as a harness, straps, belts, backpack, or other wearable device.

In a folded orientation, the cover support structure 1305 may be retracted, such as within the hands-free mechanism 1325. In some aspects, one or more of the cover support structure 1305, one or more stems 1320, and hands-free mechanism 1325 may secure the responsive umbrella 1300 in the folded orientation. For example, the hands-free mechanism 1325 may comprise a locking mechanism or strap that may prevent extension of one or more of the cover support structure 1305 or one or more stems 1320. In some aspects, the responsive umbrella 1300 may be removable from the hands-free mechanism 1325, which may allow a user 1330 to switch out responsive umbrellas 1300, such as based on use scenarios, aesthetic preferences, or when one breaks and needs to be replaced. In some embodiments, the responsive umbrella 1300 and the hands-free mechanism 1325 may be permanently attached.

Figure 14:
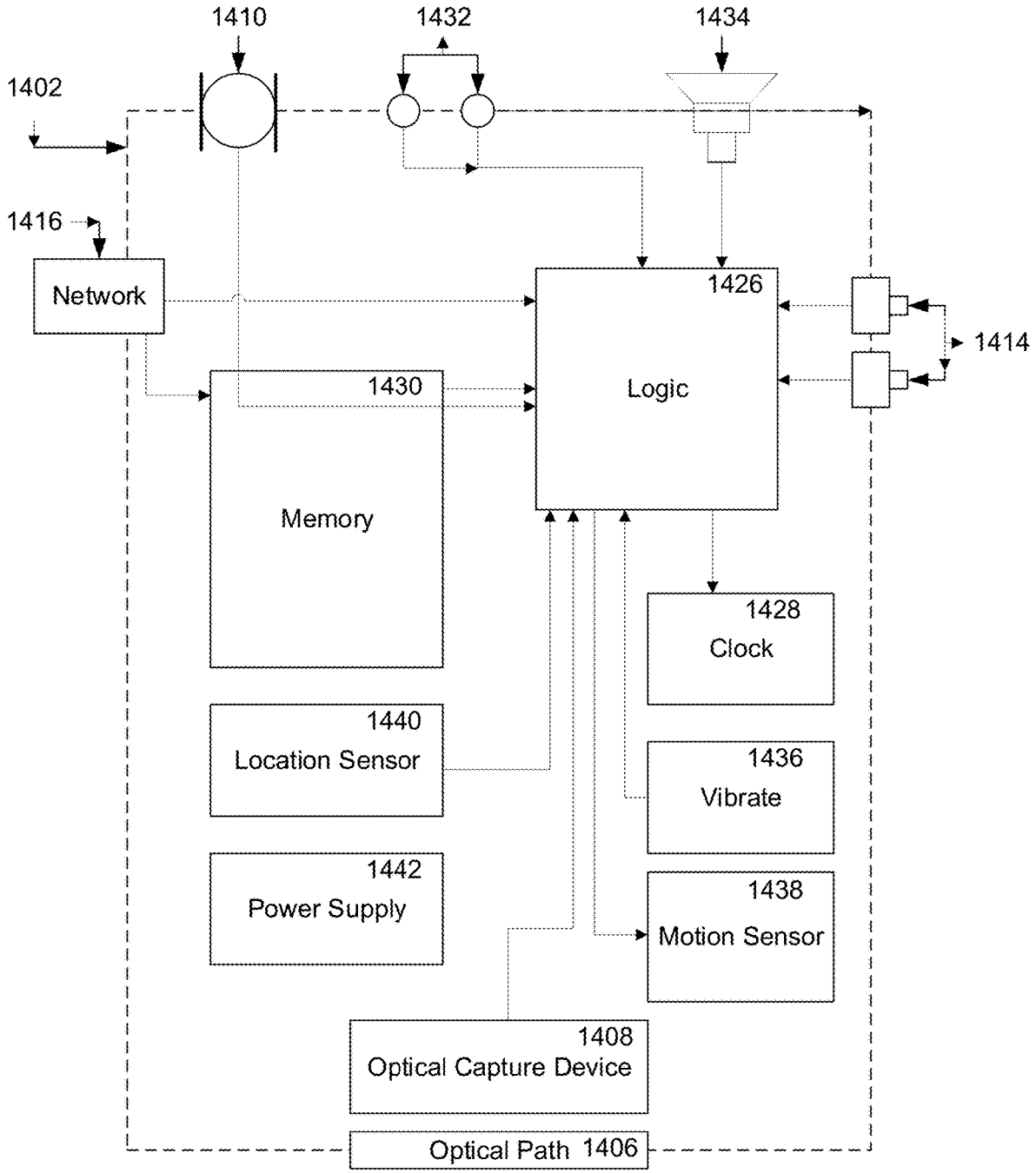
FIG. 14 illustrates an exemplary block diagram of an exemplary embodiment of a mobile device, according to some embodiments of the present disclosure.

Referring now to FIG. 14, an exemplary block diagram of an embodiment of a mobile device 1402 is illustrated. The mobile device 1402 may comprise an optical capture device 1408, which may capture an image and convert it to machine-compatible data, and an optical path 1406, typically a lens, an aperture, or an image conduit to convey the image from the rendered document to the optical capture device 1408. The optical capture device 1408 may incorporate a Charge-Coupled Device (CCD), a Complementary Metal Oxide Semiconductor (CMOS) imaging device, or an optical sensor of another type.

In some embodiments, the mobile device 1402 may comprise a microphone 1410, wherein the microphone 1410 and associated circuitry may convert the sound of the environment, including spoken words, into machine-compatible signals. Input facilities 1414 may exist in the form of buttons, scroll-wheels, or other tactile sensors such as touchpads. In some embodiments, input facilities 1414 may include a touchscreen display. Visual feedback 1432 to the user may occur through a visual display, touchscreen display, or indicator lights. Audible feedback 1434 may be transmitted through a loudspeaker or other audio transducer. Tactile feedback may be provided through a vibration module 1436.

In some aspects, the mobile device 1402 may comprise a motion sensor 1438, wherein the motion sensor 1438 and associated circuitry may convert the motion of the mobile device 1402 into machine-compatible signals. For example, the motion sensor 1438 may comprise an accelerometer, which may be used to sense measurable physical acceleration, orientation, vibration, and other movements. In some embodiments, the motion sensor 1438 may comprise a gyroscope or other device to sense different motions.

In some implementations, the mobile device 1402 may comprise a location sensor 1440, wherein the location sensor 1440 and associated circuitry may be used to determine the location of the device. The location sensor 1440 may detect Global Position System (GPS) radio signals from satellites or may also use assisted GPS where the mobile device may use a cellular network to decrease the time necessary to determine location. In some embodiments, the location sensor 1440 may use radio waves to determine the distance from known radio sources such as cellular towers to determine the location of the mobile device 1402. In some embodiments these radio signals may be used in addition to and/or in conjunction with GPS.

In some aspects, the mobile device 1402 may comprise a logic module 1426, which may place the components of the mobile device 1402 into electrical and logical communication. The electrical and logical communication may allow the components to interact. Accordingly, in some embodiments, the received signals from the components may be processed into different formats and/or interpretations to allow for the logical communication. The logic module 1426 may be operable to read and write data and program instructions stored in associated storage 1430, such as RAM, ROM, flash, or other suitable memory. In some aspects, the logic module 1426 may read a time signal from the clock unit 1428. In some embodiments, the mobile device 1402 may comprise an on-board power supply 1442. In some embodiments, the mobile device 1402 may be powered from a tethered connection to another device, such as a Universal Serial Bus (USB) connection.

In some implementations, the mobile device 1402 may comprise a network interface 1416, which may allow the mobile device 1402 to communicate and/or receive data to a network and/or an associated computing device. The network interface 1416 may provide two-way data communication. For example, the network interface 1416 may operate according to an internet protocol or near-field communication, which may communicate with a monitor. As another example, the network interface 1416 may comprise a local area network (LAN) card, which may allow a data communication connection to a compatible LAN. As another example, the network interface 1416 may comprise a cellular antenna and associated circuitry, which may allow the mobile device to communicate over standard wireless data communication networks. In some implementations, the network interface 1416 may comprise a Universal Serial Bus (USB) to supply power or transmit data. In some embodiments, other wireless links known to those skilled in the art may also be implemented.

Figure 15:
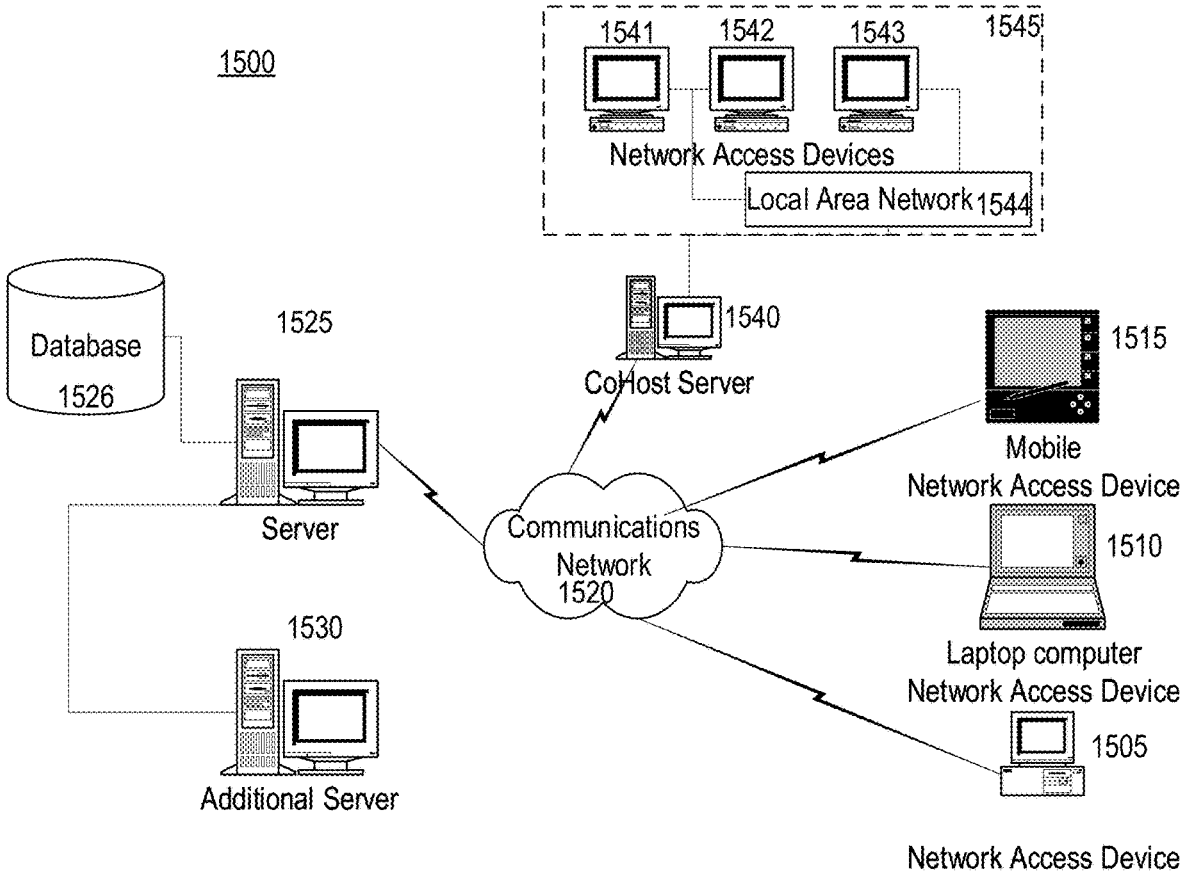
FIG. 15 illustrates apparatus that may be used to implement aspects of the present disclosure, including executable software.

Referring now to FIG. 15, an exemplary processing and interface system 1500 is illustrated. In some aspects, access devices 1515, 1510, 1505, such as a paired portable device 1515 or laptop computer 1510 may be able to communicate with an external server 1525 though a communications network 1520. The external server 1525 may be in logical communication with a database 1526, which may comprise data related to identification information and associated profile information. In some embodiments, the server 1525 may be in logical communication with an additional server 1530, which may comprise supplemental processing capabilities.

In some aspects, the server 1525 and access devices 1505, 1510, 1515 may be able to communicate with a cohost server 1540 through a communications network 1520. The cohost server 1540 may be in logical communication with an internal network 1545 comprising network access devices 1541, 1542, 1543 and a local area network 1544. For example, the cohost server 1540 may comprise a payment service, such as PayPal or a social network, such as Facebook or LinkedIn.

CONCLUSION

A number of embodiments of the present disclosure have been described. While this specification contains many specific implementation details, these should not be construed as limitations on the scope of any disclosures or of what may be claimed, but rather as descriptions of features specific to particular embodiments of the present disclosure.

Certain features that are described in this specification in the context of separate embodiments can also be implemented in combination or in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order show, or sequential order, to achieve desirable results. In certain implementations, multitasking and parallel processing may be advantageous. Nevertheless, it will be understood that various modifications may be made without departing from the spirit and scope of the claimed disclosure.

What is claimed is:

1. A hands-free responsive umbrella comprising:

a responsive umbrella comprising:

a cover configured to shield at least a portion of ambient elements for a user of the hands-free responsive umbrella when the responsive umbrella is in an expanded orientation, wherein the cover comprises a modular stem system, a cover support structure that provides rigidity to the cover, allowing the cover to maintain a predefined shape in the expanded orientation, at least one stem extending from the cover, wherein the modular stem system provides at least three stem position options for the at least one stem in at least three stem slots; and a hands-free mechanism attachable to the at least one stem, wherein the hands-free mechanism allows for use of the responsive umbrella without requiring one or both hands of the user.

2. The hands-free responsive umbrella of claim 1, wherein the hands-free mechanism is wearable.

3. The hands-free responsive umbrella of claim 2, wherein at least a portion of the responsive umbrella is detachable from the hands-free mechanism.

4. The hands-free responsive umbrella of claim 2, wherein the hands-free mechanism is adjustable to accommodate a range of user sizes.

5. The hands-free responsive umbrella of claim 2, wherein the hands-free mechanism comprises a harness.

6. The hands-free responsive umbrella of claim 2, wherein the hands-free mechanism comprises straps configured to loop around a part of the user.

7. The hands-free responsive umbrella of claim 2, wherein the at least one stem extends behind the user when the hands-free mechanism is worn.

8. The hands-free responsive umbrella of claim 7, wherein an angle of extension of the at least one stem is adjustable.

9. The hands-free responsive umbrella of claim 8, wherein the cover support structure extends directly from one or both the at least one stem and the hands-free mechanism.

10. The hands-free responsive umbrella of claim 9, wherein the cover is extendable over the user, wherein the extending unfolds the cover to at least partially cover the user.

11. The hands-free responsive umbrella of claim 10, wherein the cover further comprises handles that allow the user to extend the cover by pulling the handles.

12. The hands-free responsive umbrella of claim 11, wherein the handles further allow the user to collapse the cover behind the user.

13. The hands-free responsive umbrella of claim 2, wherein the at least one stem extends vertically from the user when the hands-free mechanism is worn.

14. The hands-free responsive umbrella of claim 13, wherein hands-free mechanism comprises straps and the at least one stem extends from the straps.

15. The hands-free responsive umbrella of claim 1, wherein the modular stem system comprises a plurality of recesses of a shape and size to accept and secure the at least one stem.

16. The hands-free responsive umbrella of claim 15, wherein placement of the at least one stem in the modular stem system occurs manually.

17. The hands-free responsive umbrella of claim 1, wherein the hands-free mechanism comprises a base that is configured to anchor the hands-free responsive umbrella to a surface on which the base is placed.

18. The hands-free responsive umbrella of claim 17, wherein the modular stem system comprises a plurality of recesses of a shape and size to accept and secure the at least one stem.

* * * * *